US008465404B2

(12) United States Patent
Hadley

(10) Patent No.: US 8,465,404 B2
(45) Date of Patent: Jun. 18, 2013

(54) CONTAINER INSERT APPARATUS AND METHOD

(75) Inventor: Bob Hadley, Swanton, OH (US)

(73) Assignee: Cutting Edge Converted Products, Inc., Toledo, OH (US)

( * ) Notice: Subject to any disclaimer, the term of this patent is extended or adjusted under 35 U.S.C. 154(b) by 454 days.

(21) Appl. No.: 12/777,849

(22) Filed: May 11, 2010
(Under 37 CFR 1.47)

(65) Prior Publication Data

US 2010/0284634 A1 Nov. 11, 2010

Related U.S. Application Data

(60) Provisional application No. 61/177,037, filed on May 11, 2009.

(51) Int. Cl.
*B31B 1/52* (2006.01)

(52) U.S. Cl.
USPC ..... 493/218; 493/217; 493/210; 493/231; 493/243; 493/254

(58) Field of Classification Search
USPC ..... 493/209, 210, 217–219, 231, 235, 493/243, 246, 254, 264
See application file for complete search history.

(56) References Cited

U.S. PATENT DOCUMENTS 2,084,362 A 6/1937 Visscher et al.
4,560,434 A 12/1985 Sato
4,679,242 A 7/1987 Brockhaus
4,685,276 A * 8/1987 Kiel ..... 53/459
4,704,842 A 11/1987 Boeckmann et al.
4,889,252 A 12/1989 Rockom et al.
5,099,991 A 3/1992 Kitagawa et al.
5,163,893 A 11/1992 Hara et al.
5,286,248 A * 2/1994 Dunton ..... 493/224
5,314,087 A 5/1994 Shea
5,375,393 A 12/1994 Baker
5,493,846 A * 2/1996 Baker et al. ..... 53/429
5,595,320 A 1/1997 Aghassipour
5,638,979 A 6/1997 Shea
5,669,204 A 9/1997 Blaisdell
5,746,690 A 5/1998 Humbarger et al.
5,755,078 A 5/1998 Hurtig et al.
5,772,332 A * 6/1998 Geller ..... 383/119
5,775,733 A 7/1998 Lunt
5,803,483 A 9/1998 Lunt (Continued)

OTHER PUBLICATIONS

Publication—Pregis, ASTRO-FOAM polyethylene sheet foam by Pregis; Information Page (revised Jun. 2007) Rhino Bags.

*Primary Examiner* — Christopher Harmon
(74) *Attorney, Agent, or Firm* — Fraser Clemens Martin & Miller LLC; James D. Miller

(57) ABSTRACT

A container insert, and an apparatus and a method of producing the container insert. The container insert is formed as a deformable pouch adapted to be received in an interior of an associated container. The pouch has a closed lower end, an open upper end, and spaced apart sealed edges. The lower end of the pouch includes two leg portions. The pouch is manipulatable to generally conform to the interior of the contained and form a hollow interior space therein for receiving an object and providing a lining for the interior of the container. The apparatus and the method for producing the insert provides for a substantially automatic and continuous production of the insert from a roll of material.

11 Claims, 5 Drawing Sheets

U.S. PATENT DOCUMENTS 5,820,268 A 10/1998 Becker et al.
6,007,467 A 12/1999 Becker et al.
6,080,096 A 6/2000 Becker et al.
6,223,903 B1 5/2001 Mansouri
6,231,237 B1 * 5/2001 Geller ..... 383/119
6,254,523 B1 7/2001 Yamamoto et al.
6,443,309 B1 9/2002 Becker
6,513,703 B2 2/2003 Becker
6,644,193 B2 11/2003 Elsner
6,676,011 B2 1/2004 Luu et al.
6,718,725 B2 4/2004 Farwig et al.
6,913,389 B2 7/2005 Kannankeril et al.
7,021,524 B1 4/2006 Becker et al.
7,140,773 B2 11/2006 Becker et al.
7,260,922 B2 * 8/2007 Harding et al. ..... 53/472
7,318,798 B2 1/2008 Yamamoto et al.
7,331,917 B2 * 2/2008 Totani ..... 493/244
7,416,091 B2 8/2008 Yong

* cited by examiner

CONTAINER INSERT APPARATUS AND METHOD

CROSS-REFERENCE TO RELATED APPLICATION

This application claims the benefit of U.S. provisional patent application Ser. No. 61/177,037 filed May 11, 2009, hereby incorporated herein by reference in its entirety.

FIELD OF THE INVENTION

The present invention relates to a container insert, and more specifically to an insulated container insert, and an apparatus and a method of producing the insert.

BACKGROUND OF THE INVENTION

Insulated container inserts are used to provide thermal insulation and moisture proof linings to standard shipping containers. U.S. Pat. No. 5,820,268 is exemplary of an insulating container insert of the prior art. The insert is typically produced from a planar sheet of moisture resistant insulating material. The insulating material is formed into a desired shape such as a cube or cuboid adapted to be received in a cardboard shipping container, for example. A series of folds are made and selected edges are joined with adhesive strips or by heat sealing. The finished insert is placed inside the shipping container to form a liner that provides thermal insulation and a moisture barrier for the shipping container.

Known processes for forming the insert typically include the creation of a series of folds in the planar sheet to form the insert with a closeable top. The process of folding the planar sheet of insulating material into the desired shape is typically labor intensive. The cost of producing the insert is increased due to the time and manual labor associated with the folding process.

It would be desirable to produce an insulated container insert employing an apparatus to minimize the labor required to produce the insert and to minimize the cost of the insert.

SUMMARY OF THE INVENTION

Compatible and attuned with the present invention, an insulated container insert produced with an apparatus to minimize the labor required to produce the insert and to minimize the cost of the insert, has surprisingly been discovered.

In one embodiment, a container insert comprises a deformable pouch adapted to be received in an interior of an associated container, the pouch having a closed lower end, an open upper end, and spaced apart sealed edges, the lower end including two leg portions, wherein the pouch is manipulatable to form a hollow interior space therein for receiving an object and providing a lining for the interior of the container.

In another embodiment, an apparatus for producing a container insert comprises a dispensing station for dispensing a material and folding the material upon itself along a longitudinal axis thereof to form a generally U-shaped folded material having opposing sides, a folded end, and an open end; a folding station for receiving the generally U-shaped folded material from the dispensing station and causing the folded end to be received between the opposing sides to form a generally W-shaped folded material; a sealing station including a seam forming element to form a seam extending from the closed end to the open end of the w-shaped folded material; a material advance mechanism to advance the material through the apparatus; a cutting station to cut the w-shaped configured material along the seam formed therein.

The invention also provides a method of producing a container insert comprising the steps of dispensing a material while folding the material upon itself along a longitudinal axis thereof to form a generally U-shaped folded material having opposing sides, a folded end, and an open end; causing at least a portion of the folded end of the generally U-shaped folded material to be received between the opposing sides thereof to form a generally W-shaped folded material; forming spaced apart seams in the generally W-shaped folded material, the seams extending from the closed end to the open end of the generally W-shaped folded material; and cutting the material along the seams from the closed end to the open end.

BRIEF DESCRIPTION OF THE DRAWINGS

The above, as well as other advantages of the invention, will become readily apparent to those skilled in the art from the following detailed description of an embodiment of the invention when considered in the light of the accompanying photos, in which.

DETAILED DESCRIPTION OF THE PREFERRED EMBODIMENT

The following detailed description and appended drawings describe and illustrate an exemplary embodiment of the invention. The description and drawings serve to enable one skilled in the art to make and use the invention, and are not intended to limit the scope of the invention in any manner. In respect of the methods disclosed, the steps presented are exemplary in nature, and the order of the steps is not regarded as necessary or critical.

Figure 2:
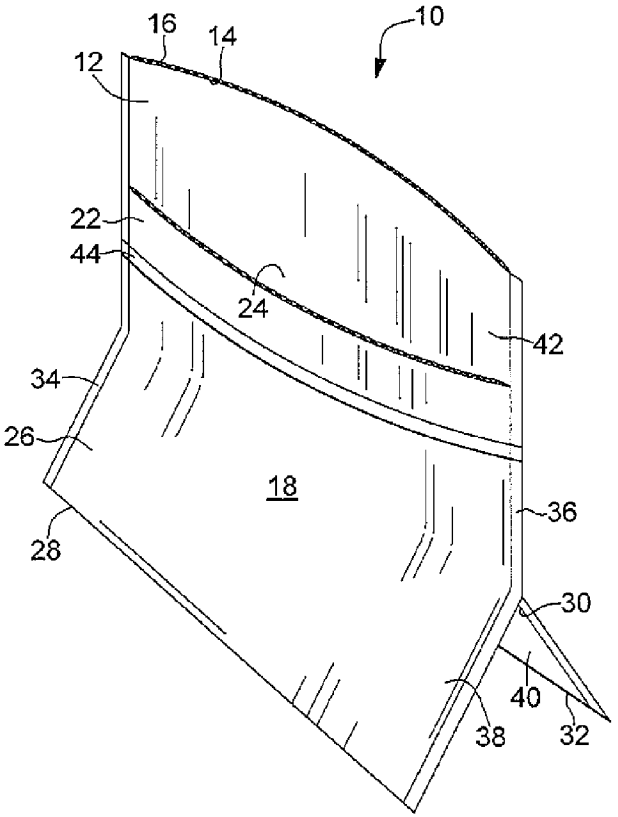
FIG. 2 is a perspective view of the insulated container insert prior to being configured as shown in FIG. 1.
Figure 1:
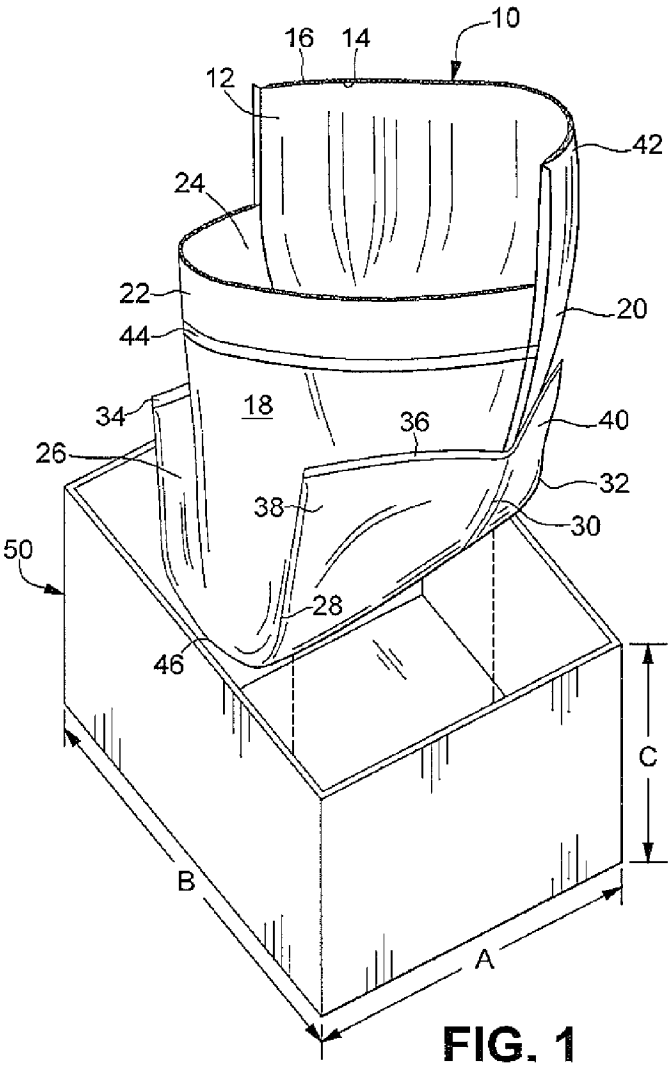
FIG. 1 is an exploded perspective view of an insulated container insert and an associated container showing the insulated container insert configured to be received in an interior of the associated container.
Figure 3:
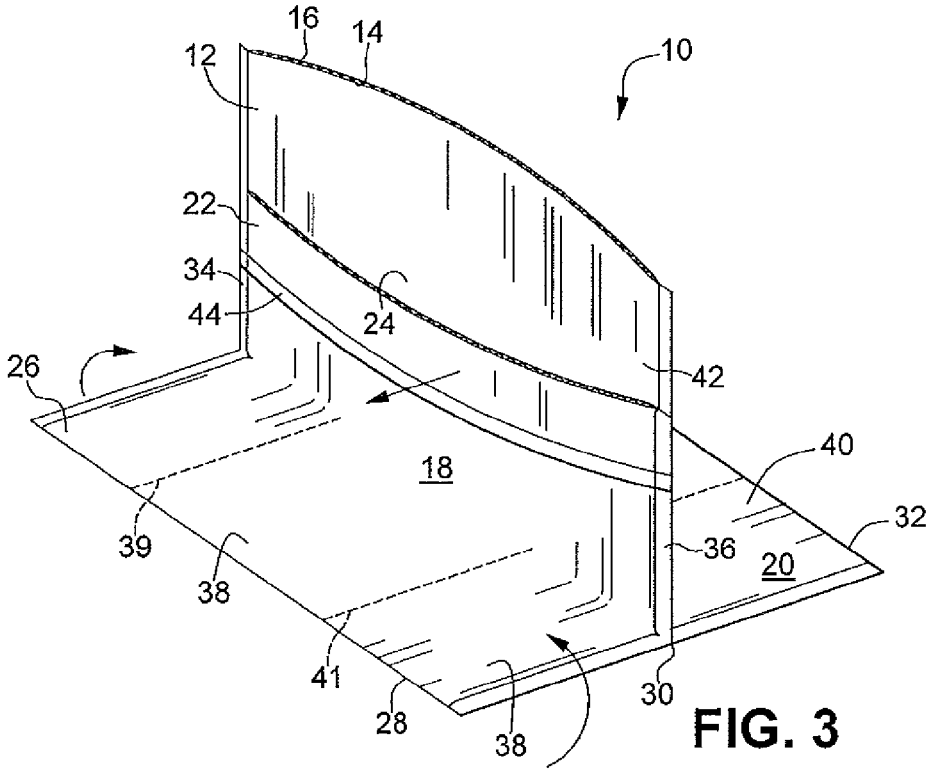
FIG. 3 is perspective view of the insulated container showing an intermediate step in configuring the insulated container as shown in FIG. 1.

Referring now to FIGS. 1-3, there is shown an insulated insert 10 for a container 50 such as a corrugated box, for example. The insert 10 is removably received in an interior of the container 50 to provide a substantially fluid tight insulated lining thereto. The insert 10 is typically produced from a deformable laminate material 12 having a layer of a bubble pack material 14 and a superposed layer of metallic foil 16. The bubble pack material 14 is a thermoplastic material to facilitate the formation of welded or heat sealed seams between abutting surfaces of the bubble pack material 14. It should be understood that other materials can be used including a non-laminate material such as a polyethylene foam or a bubble pack material; or other laminates such as metalized polyethylene, metalized polyethylene foam, metalized polyester, or metalized polypropylene, for example.

As manufactured, the insert 10 has a general pouch configuration, shown in FIG. 2, which can be manipulated to generally conform to the interior of the container 50, as shown in FIG. 1. The insert 10 includes opposing sides 18, 20; an upper end 22 having an opening 24 into an interior of the insert 10; a bottom end 26 including coextensive folded edges 28, 30, 32; and spaced apart sealed edges 34, 36. The general shape of the insert 10 is an inverted Y with leg portions 38, 40.

The insert 10 can be formed having one of the sides 18, 20 longer and extending beyond the other of the sides 18, 20 at the opening 24 to form a flap 42 adjacent the opening 24. The flap 42 can be employed to cover the opening 24 during use of the insert 10. An adhesive 44 such as a double sided pressure sensitive adhesive strip or glue, for example, can be disposed on the insert 10 adjacent the opening 24 to releasably close the flap 42 and cover the opening 24. It should be understood that the adhesive 44 can be disposed on the flap 42. It should also be understood that the insert 10 can be formed without the flap 42, wherein the sides 18, 20 are substantially the same length and the adhesive 44 is disposed adjacent the opening 24.

As shown in FIG. 3, to generally conform the insert 10 to the interior of the container 50, the leg portions 38, 40 of the insert 10 are moved away from each other to form a generally inverted T-shape of the insert 10. The horizontal portion of the T-shape forms a bottom 46 of the insert 10 when configured as shown in FIG. 1. The sealed edges 34, 36 along the leg portions 38, 40 are folded upward along fold lines 39, 41, respectively, toward the opening 24 and the opposing sides 18, 20 are moved away from each other to form the final shape of the insert 10 as illustrated in FIG. 1. The final shape of the insert 10 provides a hollow interior space for receiving objects therein. The insert 10 can be formed in the final shape while disposed in the interior of the container 50 to facilitate generally conforming the insert 10 to the interior of the container 50. It should be understood that the insert 10 is not required to conform to the exact shape of the interior of the container 50. The adhesive 44 can also be disposed on selected locations of the insert 10 to substantially secure folded portions of the insert 10 to an adjacent surface of the insert 10 to maintain a desired shape thereof and to substantially secure the insert 10 to the interior of the container 50.

As shown in FIG. 1, manipulating the insert 10 in the indicated manner positions the sealed edges 34, 36 above the bottom 46 of the insert 10 which militates against fluid or other material escaping the insert 10 through the sealed edges 34, 36 in the event the sealed edges 34, 36 are not fluid tight. After the insert 10 is generally conformed to the interior of the container 50 and inserted therein, objects can be placed within the insert 10. If desired, the flap 42 can be folded over the opening 24 and releasably secured to the insert 10 employing the adhesive 44 to substantially seal the objects within the insert 10.

Figure 4:
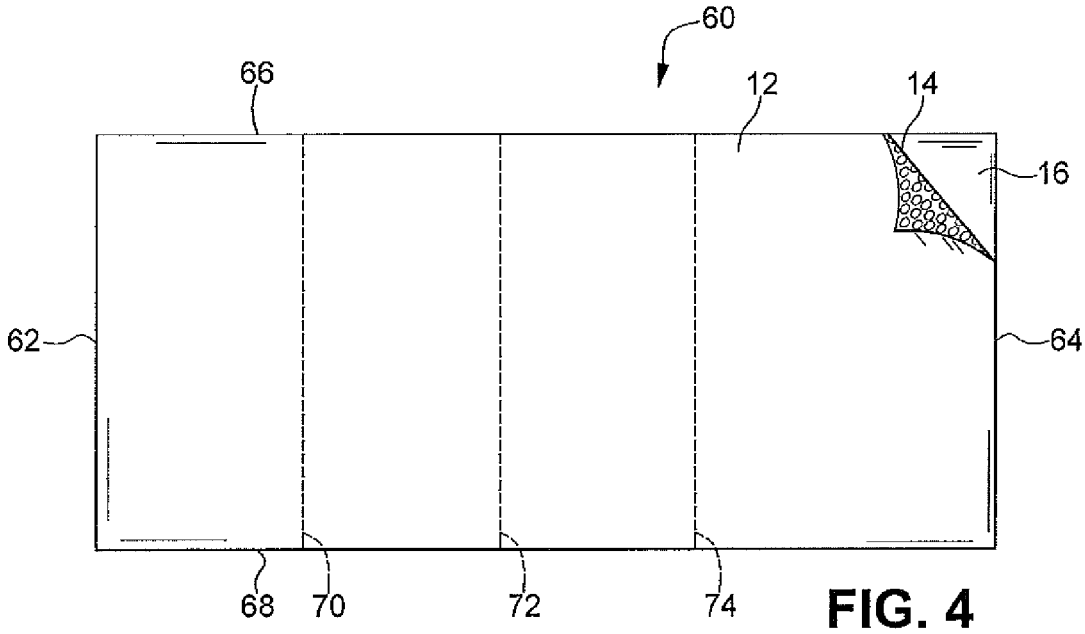
FIG. 4 is a plan view of a section of material from which the insulated container shown in FIGS. 1-3 is formed.
Figure 5:
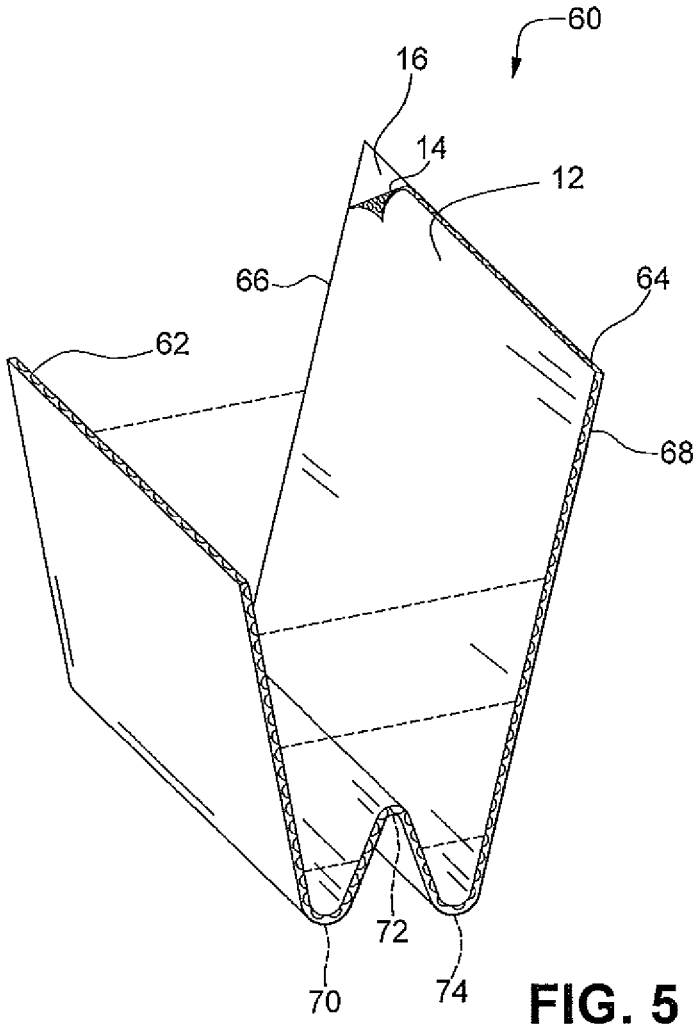
FIG. 5 is a perspective view of the section of material shown in FIG. 4 during an intermediate step in producing the insulated container shown in FIGS. 1-3.

The general steps for forming the insert 10 from a sheet of the material 12 are illustrated in FIGS. 4-5. The insert 10 is formed from a substantially rectangular section 60 of the material 12 having spaced apart end edges 62, 64 and opposing spaced apart side edges 66, 68. The sheet is folded along fold lines 70, 72, 74 to form a generally W-shaped configuration as shown in FIG. 5, wherein the fold lines 70, 72, 74 form the folded edges 28, 30, 32 in the insert 10 shown in FIG. 2. Once the material 12 is folded, the abutting portions of the respective side edges 66, 68 are joined together to form the generally inverted Y-shaped insert 10 shown in FIG. 2, wherein the joined side edges 66, 68 form the sealed edges 34, 36 of the insert 10. The side edges 66, 68 can be joined by welding, heat sealing, and employing an adhesive such as a double sided pressure sensitive adhesive strip and a glue, for example.

An apparatus 100 for producing the insert 10 in a substantially automatic and continuous process is shown in FIGS. 6-8B. The apparatus 100 includes a material dispensing station 110 having a framework 111 to support a roll 250 of a material 252 employed to form the insert 10. In the illustrated embodiment, the material 252 is the laminate material 12 having the layer of a bubble pack material 14 and the superposed layer of metallic foil 16, wherein the bubble pack material 14 forms the inner surface and the metallic foil 16 forms the outer surface of the insert 10. A folding member 112 coupled to the framework 111 to fold the material 252 upon itself along a longitudinal axis thereof. The material 252 is folded while being rotationally dispensed from the roll 250 to form a first folded configuration 254 having a generally U-shaped cross-section with opposing sides 256, 258, a folded end 260, and an open end 262. In the illustrated embodiment, the folding member 112 is a generally triangular shaped member adapted to fold the material 252 at an apex thereof and direct the folded material 252 to be received between a pair of cooperating rollers 114.

Figure 7:
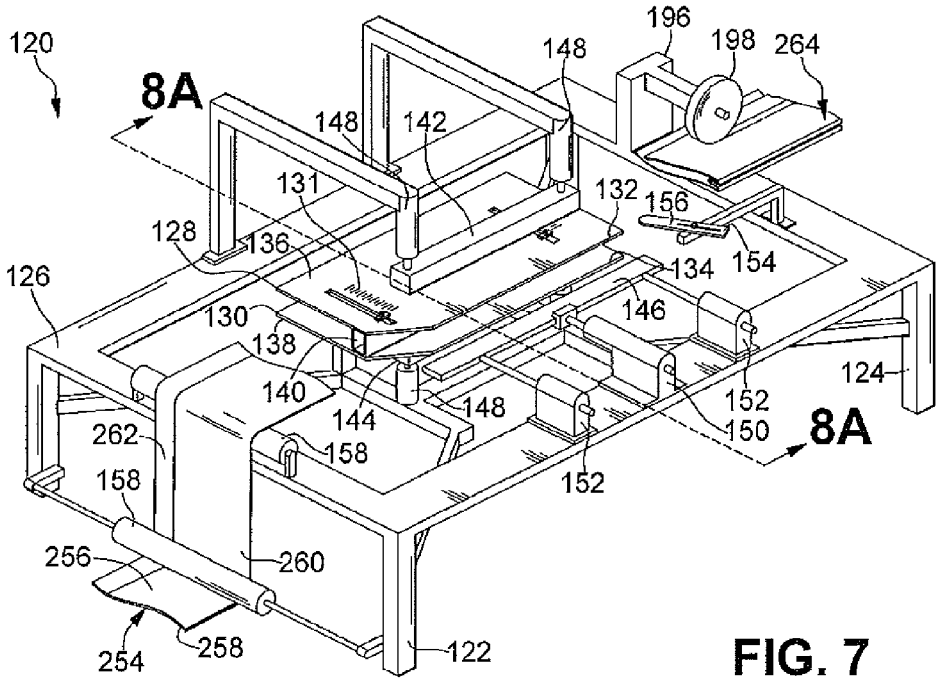
FIG. 7 is in enlarged fragmentary view of a folding station of the apparatus shown in FIG. 6.
Figure 8A:
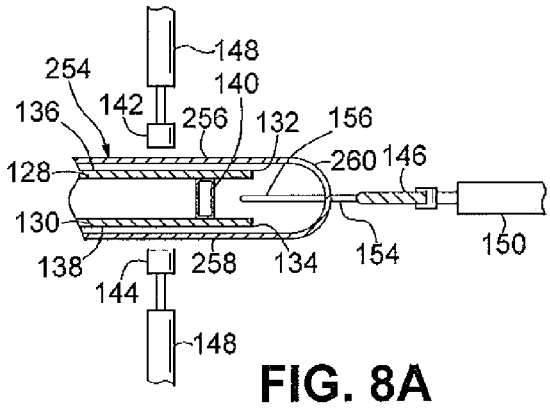
FIG. 8A is a fragmentary cross-sectional view of the folding station shown in FIG. 7 taken along line 8-8 showing a material disposed between a pair of material griping members and a pair of plates and a material folding member and the pair of plates, the material gripping members and the material folding member in a first position.
Figure 8B:
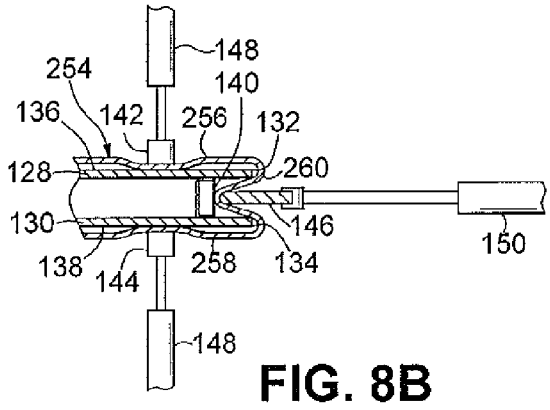
FIG. 8B is a fragmentary cross-sectional view of the folding station shown in FIG. 7 showing the material gripping members and the material folding member in a second position.

A folding station 120, more clearly shown in FIGS. 7-8B, is provided having a material receiving end 122 and a material dispatching end 124. The material folding station 120 includes a framework 126 supporting a pair of spaced apart plates 128, 130 having substantially coextensive fold forming edges 132, 134 and outwardly facing surfaces 136, 138, respectively. A dividing member 140 is adjustably disposed between the plates 128, 130 in substantially parallel alignment with the edges 132, 134. The dividing member 140 can be selectively positioned a desired distance from the edges 132, 134 of the plates 128, 130. The plates 128, 130 can include indicia 131 formed thereon to facilitate positioning the dividing member 140 at the desired distance from the edges 132, 134 of the plates 128, 130. It should be understood that the dividing member 140 can be positioned manually or an actuator can be provided to position the dividing member 140. It should also be understood that the dividing member 140 can be coupled to the framework 124 and the plates 128, 130 can be adjustably coupled to the dividing member 140.

A pair of material gripping members 142, 144 and a material folding member 146 are reciprocatively mounted to the framework 126 adjacent the plates 128, 130. Actuators 148 are provided to selectively cause the gripping members 142, 144 to move toward and away from the outwardly facing surfaces 136, 138 of the respective plates 128, 130. An actuator 150 is provided to selectively cause the material folding member 146 to move between the edges 132, 134 of the plates 128, 130 and toward the dividing member 140. A pair of linear bearings 152 is provided to facilitate the movement of the material folding member 146. It should be understood that the actuators 148, 150 can be pneumatic actuators, hydraulic actuators, electromechanical actuators, or any other suitable actuator, for example. The material receiving end 122 is adapted to receive the folded material 252 from the dispensing station 110 and direct the folded material 252 to be received around at least a portion of the plates 128, 130. The sides 256, 258 of the folded material 252 are disposed between the respective material gripping members 142, 144 and the plates 128, 130 and the folded end 260 of the material 252 is disposed between the edges 132, 134 of the plates 128, 130 and the material folding member 140, as shown in FIG. 8A. The folding station 120 is adapted to form a second folded configuration 264 having a generally W-shaped cross-section as shown in FIG. 8B.

A guide 154 including a contoured end 156 is adjustably mounted to the framework 126 adjacent the material dispatching end 124 of the folding station 120. The contoured end 156 of the guide 154 is positioned at a selected location in respect of the edges 132, 134 of the plates 128, 130 and is received between the shorter legs of the W-shaped second folded configuration 264 to facilitate maintaining the second folded configuration 264 as the material 252 is dispatched from the area of the plates 128, 130. It should be understood that rollers 158 and other suitable means for conveying the material 252 through the folding station 120 can be provided at the receiving end 122, the dispatching end 124, or a location therebetween.

A sealing station 170 is provided adjacent the dispatching end 124 of the folding station 120. The sealing station 170 includes a pair of reciprocally mounted seal forming elements 172, 174. The seal forming elements 172, 174 are employed to join selected abutting surfaces of the material 252 to form substantially fluid tight seams 266. One or more actuators 176 are employed to cause the reciprocating movement of the seal forming elements 172, 174. It should be understood that the actuators 176 can be pneumatic actuators, hydraulic actuators, electromechanical actuators, or any other suitable actuator, for example. In the illustrated embodiment, the seal forming elements 172, 174 are electrically powered heating elements adapted to receive the material 252 in the second folded configuration 264 therebetween. The heating elements are in electrical communication with a source of electrical energy (not shown) and transform the electrical energy into heat energy, which is employed to join selected abutting surfaces of the material 252 to form the substantially fluid tight seams 266. It should be understood that the seal forming elements 172, 174 can be other heating element types and employ a welding process or other suitable process to form the seams 266. It should also be understood that the seems 266 can be formed by employing an adhesive such as a double sided pressure sensitive adhesive strip and a glue disposed on the material 252 prior to folding, for example.

A material advance mechanism 180 is provided adjacent the sealing station 170. The material advance mechanism 180 receives the material 252 from the sealing station 170 and advances the material 252 through the apparatus 100. The material advance mechanism 180 exerts a pulling force that is transmitted through the material 252 causing the roll 250 of the material 252 of the dispensing station 110 to rotate and dispense the material 252 therefrom. The material advance mechanism 180 can include a pair of drive rollers 182 adapted to frictionally engage the material 252 therebetween and pull the material 252 through the apparatus 100. It should be understood that any other suitable means now known or later developed may be employed for advancing the material 252 through the apparatus 100.

A cutting station 190 is provided for cutting the material 252 after being dispatched from the sealing station 170. The cutting station 190 includes a reciprocating cutting member 192 adapted to cut through the material 252 at, or adjacent, the mid-point of a width of the seams 266 formed by the sealing station 170. It should be understood that the cutting member 192 can be a rotating cutting member, a shear, a heated wire, or any other suitable cutting apparatus. It should be understood that the cutting member 192 can both cut the material 252 and form the substantially fluid tight seams 266. For example, a heated or ultrasonic cutting member can be adapted to simultaneously cut the material 252 and join abutting surfaces of the material 252 to form the substantially fluid tight seam 266. Employing a cutting member 190 that is also forms the substantially fluid tight seams 266 can eliminate the need for the sealing station 170. Further, it should be understood that the advance mechanism 180 can be incorporated into the cutting station 190.

A dispenser 196 can be coupled to the framework 126 of the folding station 120. It should be understood that the dispenser can be coupled to the folding station 110, the sealing station 170, the material advance mechanism 180, and the cutting station 190. The dispenser 196 is adapted to apply an adhesive strip 198 such as a double sided pressure sensitive adhesive strip, for example, to a surface of the material 252. The dispenser 196 disposes the adhesive strip 198 on the material 252 as the material 252 is advanced past the dispenser 196. It should be understood that the dispenser 196 can dispense other types of adhesives such as a glue or an adhesive gum, for example.

Figure 9:
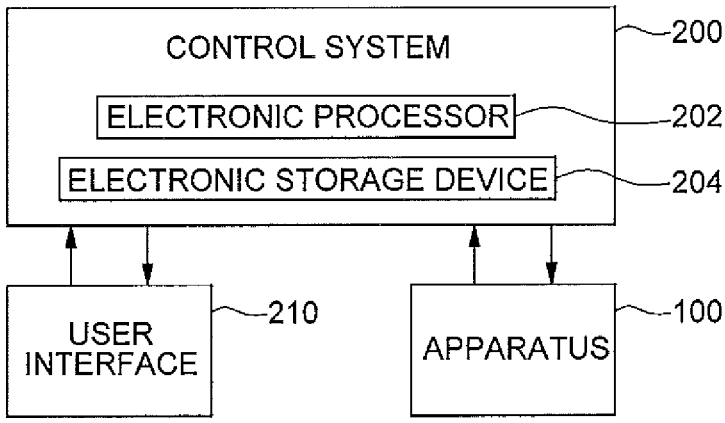
FIG. 9 is a schematic illustration of a control system in communication the apparatus shown in FIGS. 6-8B.

The apparatus 100 for manufacturing the insert 10 typically includes a control system 200 to facilitate the operation of the apparatus 100. A schematic drawing of the control system 200 is shown in FIG. 9. The control system 200 has an electronic processor 202 adapted to control the operation of the apparatus 100. The control system 200 is in communication with and receives control parameters entered by a user through a user interface 210 and provides corresponding outputs to control the operation of the apparatus 100. For example, the control system 200 can provide outputs to the material dispensing station 110; the actuators 148, 150, 176 to selectively cause a movement of the material gripping members 142, 144, the material folding member 146, and the seal forming elements 172, 174, respectively; the seal forming elements 172, 174 of the sealing station 170 to control the heat energy produced thereby; the material advance mechanism 180 to control the advancement of the material 252 through the apparatus 100; and the cutting member 122 to control the operation thereof. The control system 200 can also receive inputs from the apparatus 100 such as selected operating conditions and associated data such as the number of inserts 10 made and the quantity of material 252 consumed, wherein the inputs from the apparatus 100 can be employed to modify the outputs to control the operation of the apparatus 100. An electronic storage device 204 can be provided and placed in electrical communication with the processor 202 to receive and store data such as the control parameters received from the user interface 210 and selected input and output from the processor 202. It should be understood that the user interface 210 can be employed to view, transfer, and erase data from the electronic storage device 204. It should also be understood that the control system 200 can also be employed to control the position of the dividing member 140.

Figure 6:
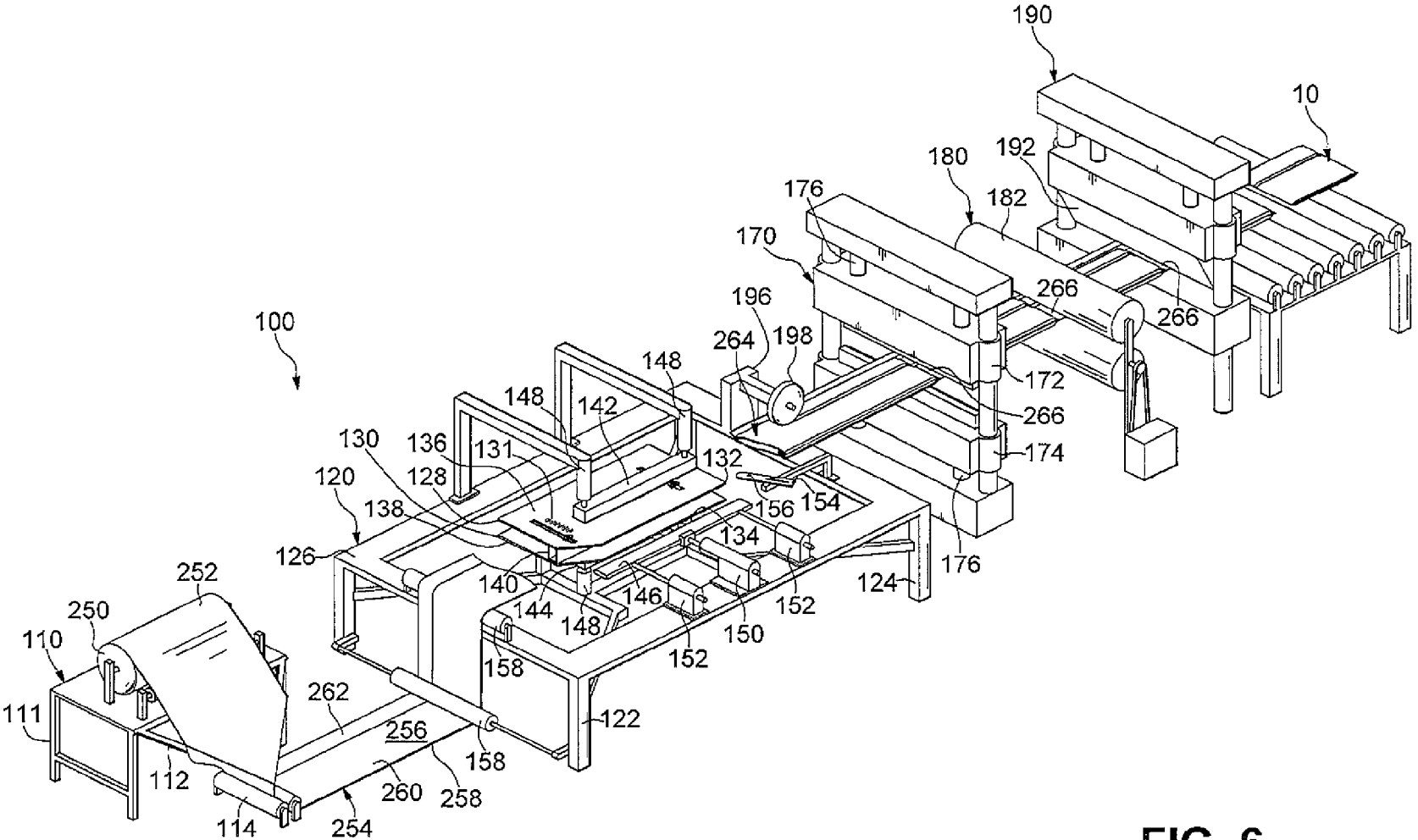
FIG. 6 is a perspective view of an apparatus for producing the insulated container insert shown in FIGS. 1-3.

In use, the roll 250 of the material 252 is placed in the dispensing station 110 of the apparatus 100 as shown in FIG. 6. The material 252 is dispensed from the roll 250 and folded upon itself by the folding member 112 along a longitudinal axis thereof to form the first folded configuration 254. It should be understood that the material 252 can be folded along a longitudinal centerline to place longitudinal edges in substantial alignment or folded along a selected longitudinal line to cause longitudinal edges along the open end 262 to be offset, thereby creating the flap 42 of the insert 10.

After folding the material 252 into the first folded configuration 254, the material 252 is advanced as a continuous folded sheet to the material receiving end 122 of the folding station 120. As can be more clearly seen in FIG. 7-8B, the material 252 is advanced through the folding station 120 having the plates 128, 130 located between the opposing sides 256, 258 of the first folded configuration 254. The folded end 260 is disposed between the edges 132, 134 of the plates 128, 130 and the material folding member 146. The opposing sides 256, 258 of first folded configuration 254 are disposed between the outwardly facing surfaces 136, 138 of the plates 128, 130 and the material gripping members 142, 144 as can be clearly seen in FIG. 8A. While the material 252 is stationary, the actuators 148 are employed to move the material gripping members 142, 144 toward the respective outwardly facing surfaces 136, 138 of the plates 128, 130. As can be clearly seen in FIG. 8B, the material gripping members 142, 144 secure the material 252 against the outwardly facing surfaces 136, 138 of the plates 128, 130. The actuator 150 is employed to move the material folding member 146 between the plates 128, 130 toward the dividing member 140 while the material is secured against the outwardly facing surfaces 136, 138 of the plates 128, 130. The material folding member 146 contacts the folded end 260 of the first folded configuration 254 and pushes the folded end 260 between the plates 128, 130 toward the dividing member 140. As can be seen in FIG. 8B, the material folding member 146 folds the material 252 around the edges 132, 134 of the plates 128, 130 to form the second folded configuration 264. The folds in the material 252 around the edges 132, 134 of the plates 128, 130 form the folded edges 28, 32 in the insert 10 shown in FIG. 2, while the fold in the material 252 formed between the dividing member 140 and the material folding member 146 forms the folded edge 30 in the insert 10 shown in FIG. 2. The material folding member 146 can be caused to force the material 252 against the dividing member 140 to facilitate forming the second folded configuration 264. It should be understood that a desired displacement of the folded end 260 of the first folded configuration 264 between the plates 128, 130 is obtained by positioning the dividing member 140 at a selected distance from the edges 132, 134 of the plates 128, 130 and establishing a cooperating stroke length of the material folding member 146.

The material folding member 146 is caused be removed from between the plates 128, 130 after the material 252 has been formed to the second folded configuration 264. The gripping members 142, 144 are caused to move away from the respective outwardly facing surfaces 136, 138 of the plates 128, 130 to release the material 252 from being secured against the outwardly facing surfaces 136, 138 of the plates 128, 130. The material 252 is then advanced a selected distance by the material advance mechanism 180 to bring a new section the first folded configuration 254 in position around the plates 128, 130 for folding into the second folded configuration 264.

The guide 154 is positioned adjacent the dispatching end 124 of the folding station 120 with the contoured end 156 of the guide 154 located between the folded edges forming the generally W-shape of the second folded configuration 264. The contoured end 154 of the guide 152 facilitates maintaining the material 252 in the second folded configuration 264 as it is advanced from the dispatching end 124 of the folding station 120 toward the sealing station 170.

The material 252 is advanced from the dispatching end 124 of folding station 120 in the second folded configuration 264 to the sealing station 170. The material 252 is received, between the seal forming elements 172, 174 of the sealing station 170. The actuators 176 are employed to position the seal forming elements 172, 174 adjacent the material 252 and form the substantially fluid tight seam 266 extending from the folded edges to the open end of the second folded configuration 264. The seam 266 is substantially perpendicular to the folded edges and the open end. The material 252 is advanced a selected distance to form the next seam 266 spaced apart from the previously formed seam 266. It should be understood that the seal forming elements 172, 174 join abutting surfaces of the bubble pack material 12 to form the seams 266. The abutting surfaces of the metallic foil 16 are not joined together by the seal forming elements 172, 174.

The material 252 is advanced the selected distance to place the seam 266 within the cutting station 190 and in substantial alignment with the cutting member 192 thereof. The cutting member 192 is employed to cut through the material 252 substantially at the midpoint of the width of the seam 266 along the length thereof to form one of the sealed edges 34, 36 in one insert 10 and one of the other sealed edges 34, 36 in a subsequently formed insert 10. It should be understood that the cutting member 192 can cut the material 252 forming the flap 42 of the insert 10 extending from the open end of the second configuration 264. The material 252 is again advanced the selected distance to bring the next seam 266 in substantial alignment with the cutting member 192 of the cutting station 190 to cut the material 252 along the length of the next seam 266 forming the other of the sealed edges 34, 36 of the subsequently formed insert 10 and completing the manufacture thereof. It should be understood that the distance from the seal forming elements 172, 174 of the sealing station 170 to the cutting member 192 of the cutting station 190 is substantially equivalent to the selected distance the material 252 is advanced, wherein the forming of one of the seams 266 and the cutting of the formed seam 266 can be completed substantially simultaneously. Further, it should be understood that the distance from the seal forming elements 172, 174 to the cutting member 192 can be adjusted to form the seams 266 at selected distances from each other to form different sizes of the insert 10. It should also be understood that the distance between the seams 266 can be greater than the distance between the sealing station 170 and the cutting member 192, wherein the formation of one seam 266 and the cutting of the formed seam 266 are not simultaneous and the material 252 is advanced a selected distance after the seam 266 is cut and before next seam 266 is formed.

The tape dispenser 196 can be attached to the dispensing station 110, the folding station 120, the sealing station 170, or the cutting station 190 to dispose the adhesive strip 198 on a selected surface of the material 252. Favorable results have been obtained attaching the tape dispenser 196 to the folding station 120 adjacent the dispatching end 124 to dispose the adhesive strip 198 on an outer surface of the material 252 adjacent the open end of the second folded configuration 264 to facilitate releasably securing the flap 42 of the insert 10 in a closed position.

The completed insert 10 is removed from the apparatus 100 by an operator or an automated means. The insert 10 can then be manipulated as described herein above to conform the insert 10 to the interior shape of the container 50.

The dimensions of the container 50 can be employed to calculate the desired dimensions of the insert 10 and the selected distance for advancing the material through the apparatus. FIG. 1 shows the container 50 having a width A, a depth B, and a height C (in inches). In general, half the distance of an outer perimeter of the container (A+B in the illustrated embodiment) is equal to the distance the material 252 is advanced to form the insert 10 for the container 50, which is substantially equivalent to a length of the insert 10 shown in FIG. 2. The required length of the shorter legs in the generally W-shaped second configuration 264 is calculated by dividing the shorter of width A and length B by two (2). The calculated required length of the shorter legs in the generally W-shaped second configuration 264 is substantially equivalent to the distance for setting the dividing member 140 from the edges 132, 134 of the plates 128, 124. The required length of the longer legs in the generally W-shaped second configuration 266 is calculated by dividing the shorter of width A and length B by two (2) and subtracting that result from the sum of height C, the shorter of width A and length B, and 1 divided by two (2) [(C+(A or B)+1)/2−(A or B)/2=length of long leg of the generally W-shaped second configuration 266]. The minimum width of the material 252 required to form the insert 10 for the container 50 is calculated by adding together the calculated lengths of the shorter leg and the longer leg of the generally W-shaped second configuration 264 and multiplying the result by two (2). In the event it is desired to form the flap 42 for the insert 10, the width of the material 252 is increased by an amount equal to the desired length of the flap 42. It should be understood that the material 252 can be slit while being dispensed to provide a desired width to the material 252.

The completed insert 10 is manufactured at a minimized cost compared to the inserts of the prior art. Rather than making a multitude of precision folds in a precut blank of material, the apparatus 100 can be used to manufacture the insert 10 in a substantially continuous automated process which minimizes a time and a cost required to manufacture the insert 10.

From the foregoing description, one ordinarily skilled in the art can easily ascertain the essential characteristics of this invention, and without departing from the spirit and scope thereof, can make various changes and modifications to the invention to adapt it to various usages and conditions.

What is claimed is:

1. An apparatus for producing a container insert comprising:

a dispensing station for dispensing a material and folding the material upon itself along a longitudinal axis thereof to form a generally U-shaped folded material having opposing sides, a folded end, and an open end;

a folding station including a pair of spaced apart plates for receiving the generally U-shaped folded material from the dispensing station and a material folding member selectively received between the plates for causing the folded end to be received between the opposing sides to form a generally W-shaped folded material;

a sealing station including a seam forming element to form a seam extending from the folded end to the open end of the w-shaped folded material;

a material advance mechanism to advance the material through the apparatus; and a cutting station to cut the w-shaped configured material along the seam formed therein;

wherein the folding station includes a framework to support the pair of spaced apart plates and a pair of reciprocatively mounted material gripping members configured to move toward and away from the plates, wherein the gripping members secure the opposing sides of the generally U-shaped folded material against the plates while the material folding member is received between the plates to push the folded end of the generally U-shaped folded material therebetween to form the generally w-shaped folded material.

2. The apparatus for producing a container insert according to claim 1, wherein the dispensing station includes a framework for supporting a roll of the material to rotatingly dispense the material therefrom.

3. The apparatus for producing a container insert according to claim 2, wherein the dispensing station includes a folding member and a pair of cooperating rollers coupled to the framework, wherein the folding member is configured to fold the material to form the generally U-shaped folded material and direct the generally U-shaped folded material to be received between the rollers.

4. The apparatus for producing a container insert according to claim 1, wherein the folding station includes a guide moveably mounted to the framework adjacent the plates to facilitate maintaining the shape of the generally W-shaped folded material while dispatching the material from the folding station.

5. The apparatus for producing a container insert according to claim 1, wherein the seam forming elements are reciprocatively mounted heating elements.

6. The apparatus for producing a container insert according to claim 1, wherein the material advance mechanism includes a pair of drive rollers to frictionally engage the material and pull the material through the apparatus.

7. The apparatus for producing a container insert according to claim 1, wherein the cutting station includes a cutting member.

8. The apparatus for producing a container insert according to claim 1, wherein the cutting station is one of a rotating cutting member, a shear, and a heated wire.

9. The apparatus for producing a container insert according to claim 1, further comprising a dispenser coupled to the folding station to apply an adhesive strip to the material.

10. The apparatus for producing a container insert according to claim 1, further comprising a control system in communication with a user interface and the apparatus, the control system receiving inputs from the user interface and providing outputs effective to control the operation of at least one of the material dispensing station, the folding station, the sealing station, the material advance mechanism, and the cutting station of the apparatus.

11. The apparatus for producing a container insert according to claim 10, wherein the control system includes an electronic storage device to receive and store inputs from the user interface.

* * * * *